US007257911B2

(12) United States Patent
Voitchovsky

(10) Patent No.: US 7,257,911 B2
(45) Date of Patent: Aug. 21, 2007

(54) IRONING APPARATUS

(75) Inventor: Serge Voitchovsky, Mézières (CH)

(73) Assignee: LauraStar S.A., Chatel-St-Denis (CH)

( * ) Notice: Subject to any disclaimer, the term of this patent is extended or adjusted under 35 U.S.C. 154(b) by 877 days.

(21) Appl. No.: 10/450,174

(22) PCT Filed: Apr. 23, 2002

(86) PCT No.: PCT/CH02/00225

§ 371 (c)(1),
(2), (4) Date: Jun. 11, 2003

(87) PCT Pub. No.: WO02/090641

PCT Pub. Date: Nov. 14, 2002

(65) Prior Publication Data

US 2004/0172867 A1 Sep. 9, 2004

(30) Foreign Application Priority Data

May 10, 2001 (CH) ..... 0852/01

(51) Int. Cl.
*D06F 75/24* (2006.01)
*D06F 75/14* (2006.01)

(52) U.S. Cl. ..... 38/77.83; 38/77.81

(58) Field of Classification Search ..... 38/74, 38/77.7, 77.83, 82, 84, 77.81
See application file for complete search history.

(56) References Cited

U.S. PATENT DOCUMENTS 1,851,777 A 3/1932 Schwartz
2,865,119 A * 12/1958 Pratt ..... 38/77.7
3,263,350 A 8/1966 Abraham
5,341,585 A 8/1994 Stephan et al.
5,430,963 A 7/1995 Kuo-Chu
5,630,287 A * 5/1997 Shimosaka et al. ..... 38/77.3
5,842,295 A 12/1998 Ching et al.
6,438,876 B2 * 8/2002 Har et al. ..... 38/77.7
6,615,515 B1 * 9/2003 Wu ..... 38/77.83

FOREIGN PATENT DOCUMENTS

EP 0 618 324 10/1994
GB 2 217 351 10/1989

* cited by examiner

*Primary Examiner*—Ismael Izaguirre
(74) *Attorney, Agent, or Firm*—Nixon Vanderhye P.C.

(57) ABSTRACT

The invention concerns an ironing apparatus comprising an iron (1), a water reservoir and a pipe (2) connecting the reservoir to the iron (1), the sole plate (4) of the iron (1) including an evaporation chamber (5) adapted to generate steam from the water coming from the reservoir, the evaporation chamber (5) including on one of its walls (6) a water inlet (7), the iron further including a device for closing and opening (8) said inlet (7). Said ironing apparatus is characterized in that it comprises a device for forcing the displacement of the water arranged between the reservoir and evaporation chamber (5), the latter including a mobile wall (8) arranged parallel and opposite the wall (6) including the inlet (7), said mobile wall (8) acting as valve for said inlet (7).

5 Claims, 5 Drawing Sheets

IRONING APPARATUS

This application is the US national phase of international application PCT/CH02/00225 filed 23 Apr. 2002 which designated the U.S.

TECHNICAL FIELD

The invention relates to an ironing apparatus with the generation of steam.

PRIOR ART

Ironing apparatuses comprising an iron, a water reservoir and a pipe connecting the reservoir to the iron are known.

In several devices, the steam is generated separately from the iron, at the reservoir. It is then conveyed to the iron through a pipe.

With the apparatus disclosed in American patent U.S. Pat. No. 3,852,899, the steam is generated in the iron, within a vaporizing chamber situated above the sole.

With the apparatuses described in patent documents U.S. Pat. Nos. 5,430,963, 5,842,295, GB 2,217,351 and EP 0 618 324, the vaporizing chamber is situated in the sole.

The apparatuses described in the aforementioned documents have several advantages:

- increased system safety because the user no longer has to open and fill a steam generator (boiler) but has simply to perform these operations on a water reservoir at ambient temperature;
- reduced heating time;
- reduction in manufacturing costs because there is no longer any external pressurized steam generator and transfer of steam via a lagged pipe;
- energy saving because the heat is now confined to the iron.

However, these apparatuses do suffer from certain disadvantages, particularly:

- a relatively long lag between the demand for steam and the generation of steam;
- poor quality of the steam where it leaves the sole as a result of the presence of unvaporized water or condensate therein.

SUMMARY OF THE INVENTION

The present invention offers, amongst other things, the advantage of overcoming the aforesaid problems.

It relates to an ironing apparatus comprising an iron, a water reservoir and a pipe connecting the reservoir to the iron, the sole of the iron comprising a vaporizing chamber designed to generate steam from water originating from the reservoir, the vaporizing chamber comprising, on one of its walls, a water inlet orifice, the iron further comprising means for opening and closing said inlet orifice, the ironing apparatus being characterized in that it comprises means for forcing the displacement of the water, which means are arranged between the reservoir and the vaporizing chamber, the vaporizing chamber comprising a moving wall arranged parallel to and facing the wall that has the inlet orifice, said moving wall acting as a valve for said inlet orifice.

The "means for forcing the displacement of the water" may for example consist of a pump or more simply consist of mains pressure when the pipe is connected directly to a faucet. In the latter instance, the term "water reservoir" is therefore to be understood as meaning the mains.

The vaporizing chamber in the iron according to the invention therefore has a variable volume, which is zero when the moving wall is pressed against the wall containing the water inlet orifice and which increases above and beyond a certain pressure exerted by the water at the inlet orifice.

As the walls of the vaporizing chamber are heated, for example by a resistive electric element which heats the entirety of the sole, this means that the water is rapidly turned into steam when it enters the vaporizing chamber.

It should be pointed out that the variable volume of the vaporizing chamber ensures optimum contact between the heating surface consisting of the walls of the chamber and the water, the latter as a result being turned into steam far more quickly than it is in the vaporizing chambers of apparatuses of the prior art.

According to a preferred embodiment, the moving wall has the shape of a disk, the face of the disk not facing said inlet orifice being in contact with a spring arranged in such a way that it exerts a force on the disk toward the inlet orifice.

In one particularly advantageous embodiment of the invention, under the inlet orifice, the disk has a cylindrical cavity which contains an inner disk arranged on a spring. This configuration in particular has the advantage of improving the quality of the flow of steam.

According to a preferred embodiment, the face of the disk and/or of the inner disk that faces toward the water inlet orifice has concentric striations.

The concentric striations act as a trap for the unvaporized water or condensate that the steam carries with it as it travels toward the periphery of the disk. The water trapped in these striations which are preferably arranged in concentric circles, finds itself as if in a mini-boiler, closed by contact between the disk and the wall containing the water inlet orifice. This water in turn vaporizes instantly at a high temperature and a high pressure and the steam thus formed forms part of the overall vaporization which escapes to the outside of the disk.

According to another preferred embodiment, but one which has the same result as in the previous embodiment, the concentric striations are arranged on the wall containing the water inlet orifice, around the latter.

As a preference, the cross section of the striations is V-shaped. This is because it has been found that vaporization is optimized using such a geometry.

According to one embodiment, the striations are discontinuous.

Other particulars and advantages of the invention will become further apparent from the following nonlimiting examples.

Figure 1:
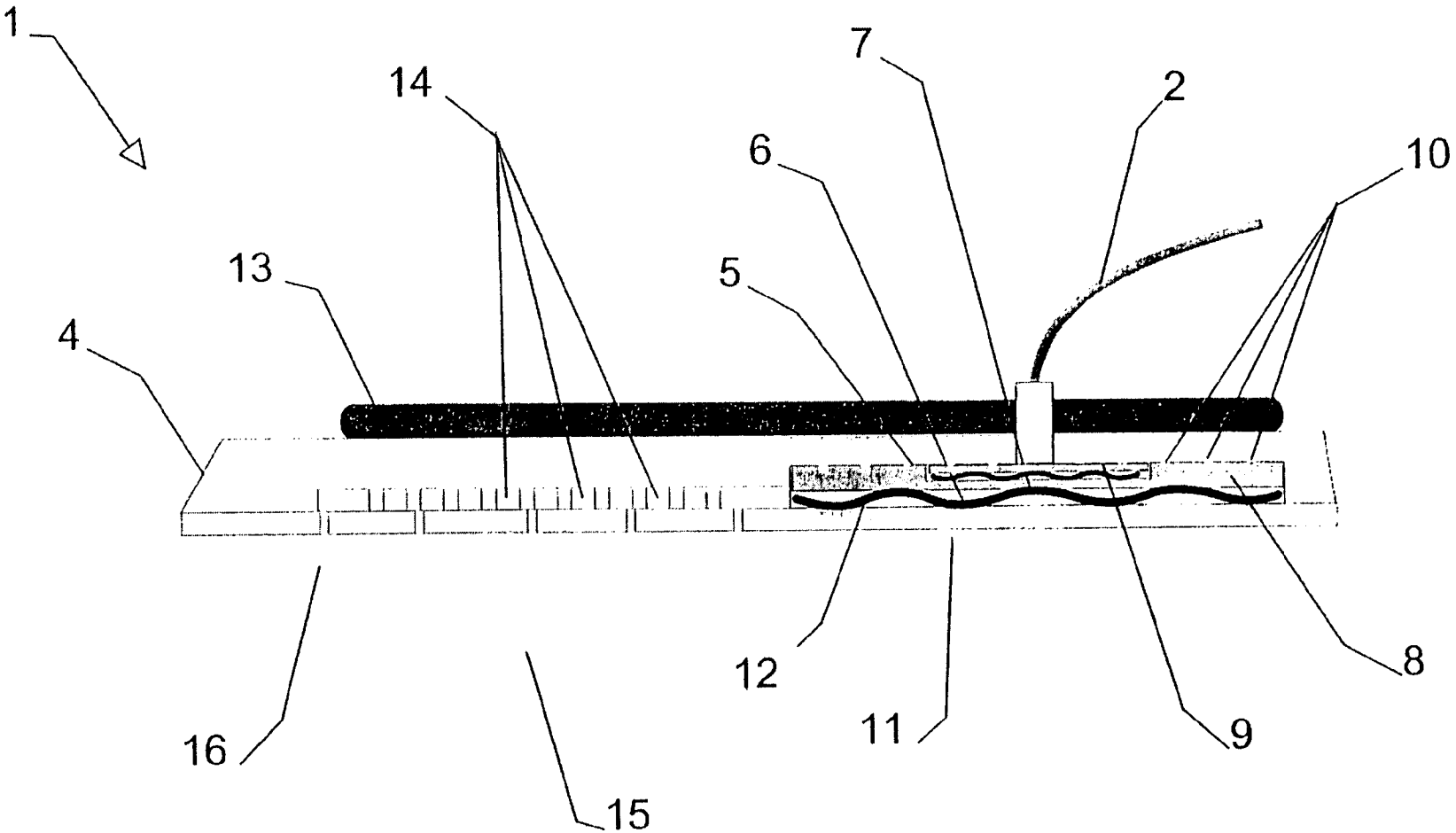
FIG. 1 depicts a section from the side of the base of an iron according to the invention
Figure 2:
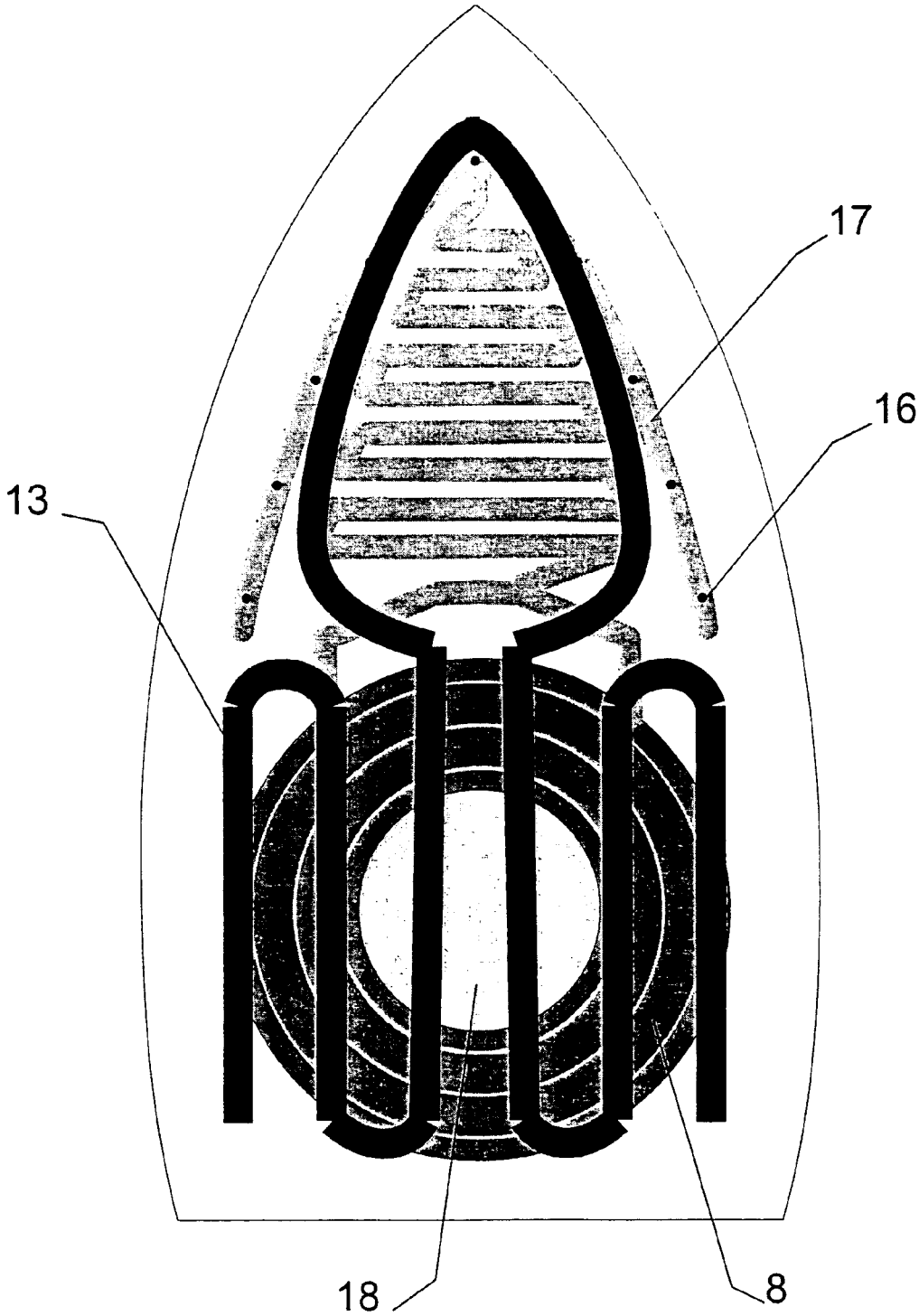
FIG. 2 depicts a view from above of the element of FIG. 1
Figure 3:
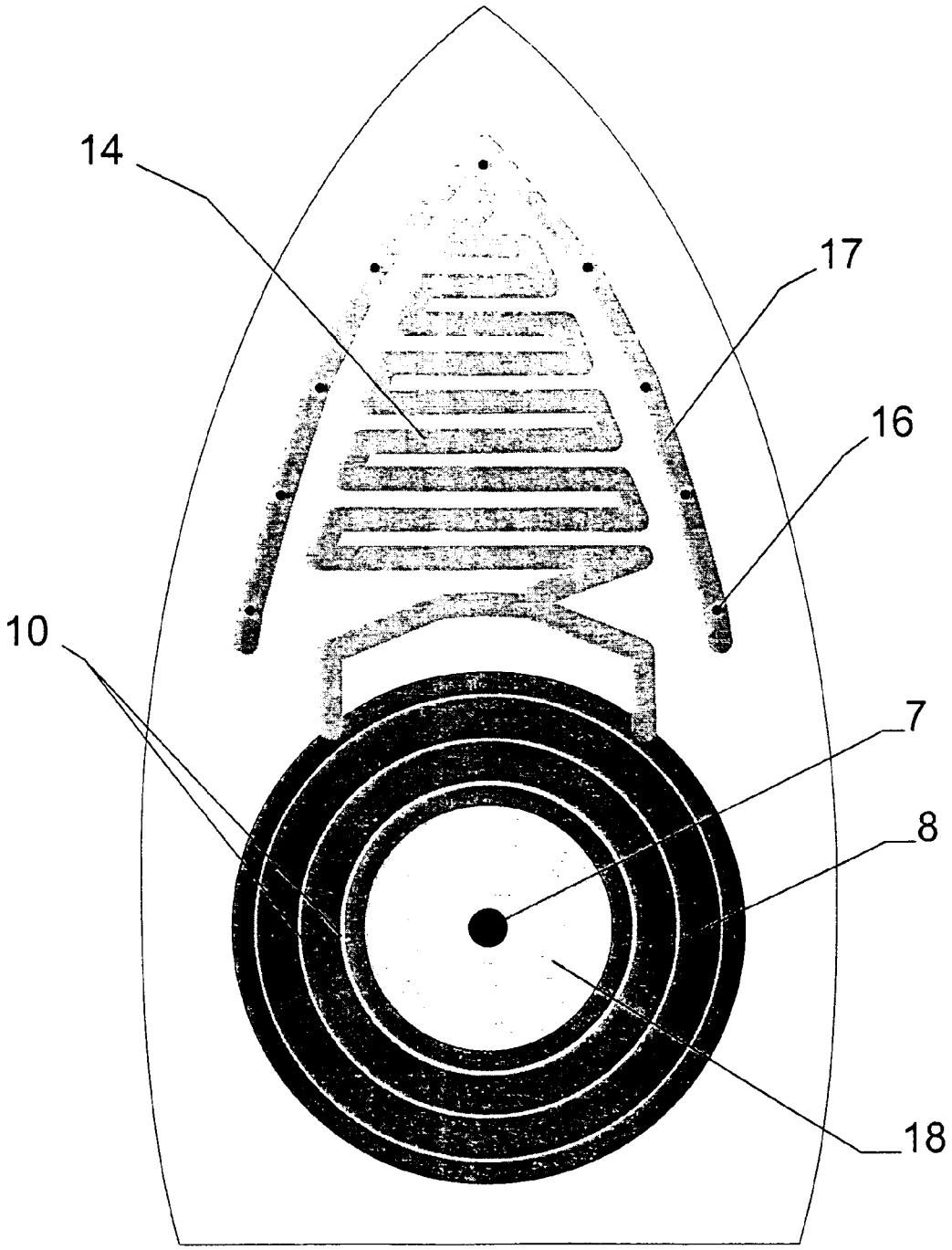
FIG. 3 depicts a view of this same element, from underneath
Figure 4:
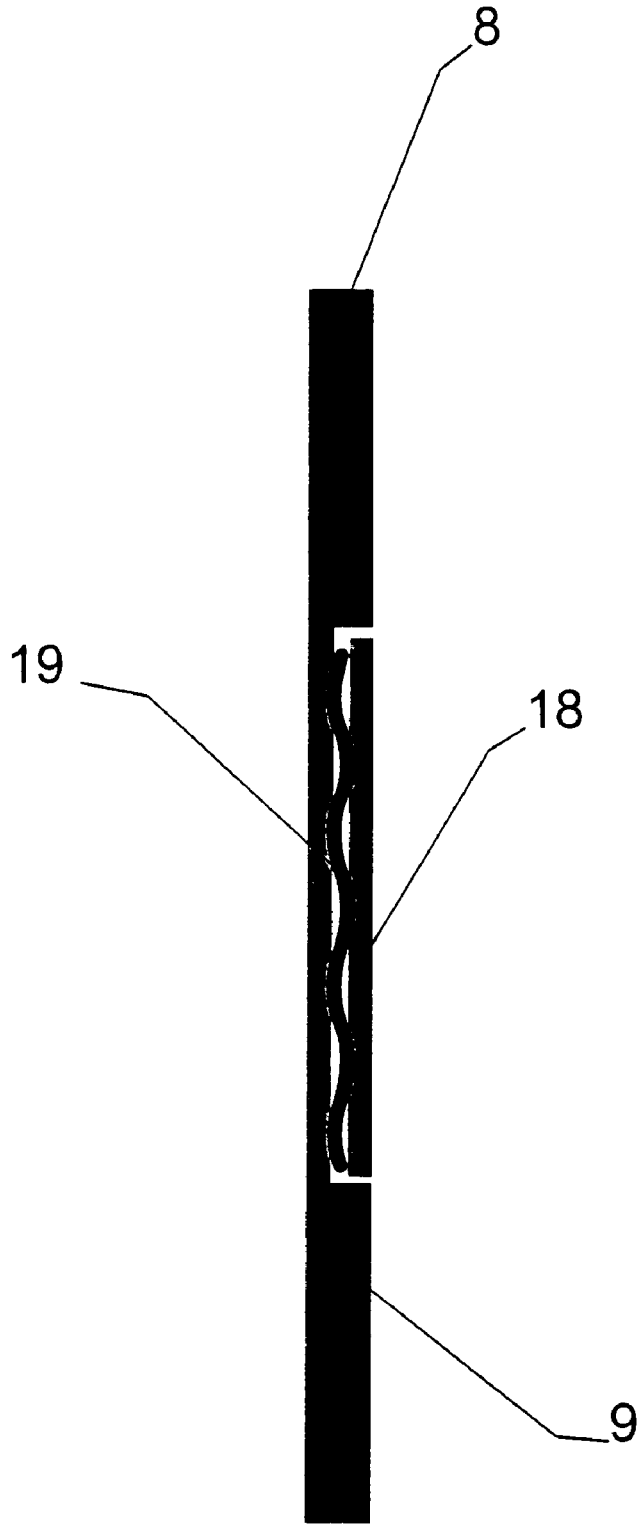
FIG. 4 depicts an enlargement of part of FIG. 1

The apparatus depicted in part in FIGS. 1 and 3 is made up of an iron (1), only the lower part of which is illustrated, of a reservoir (not illustrated) external to the iron, of a pump (also not illustrated) and of a pipe (2). The sole (4) of the iron (1) comprises a vaporizing chamber (5) connected to a labyrinth (14) for superheating the steam, which labyrinth is itself connected to a duct (17) that leads to outlet orifices (16) where the steam (15) is injected into the fabric being ironed. A heater body (13) is arranged above of the sole (4) so as to transmit heat with the latter. The vaporizing chamber (5) comprises, on one of its walls (6), an inlet orifice (7) for water originating from the reservoir. The opposite wall of the vaporizing chamber (5) to the one (6) containing the inlet orifice (7) has the form of a moving disk (8) (see also FIG. 4). Under the inlet orifice (7), the disk (8) comprises a circular cavity containing an inner disk (18) arranged on a spring (19).

In the rest mode, that is to say when the pump is not running, the disk (8) is pressed against the wall (6) containing the inlet orifice (7) by means of a spring (12) exerting a force on the opposite face (11) of the disk, the inner disk (18) being itself pressed against the inlet orifice (7), particularly by virtue of the spring (19) arranged in the cylindrical cavity. The wall (6) containing the inlet orifice (7) is also equipped with a series of concentric striations (10) in the form of circles arranged around the inlet orifice (7). According to an alternative form of embodiment the concentric striations may be discontinuous.

Figure 5:
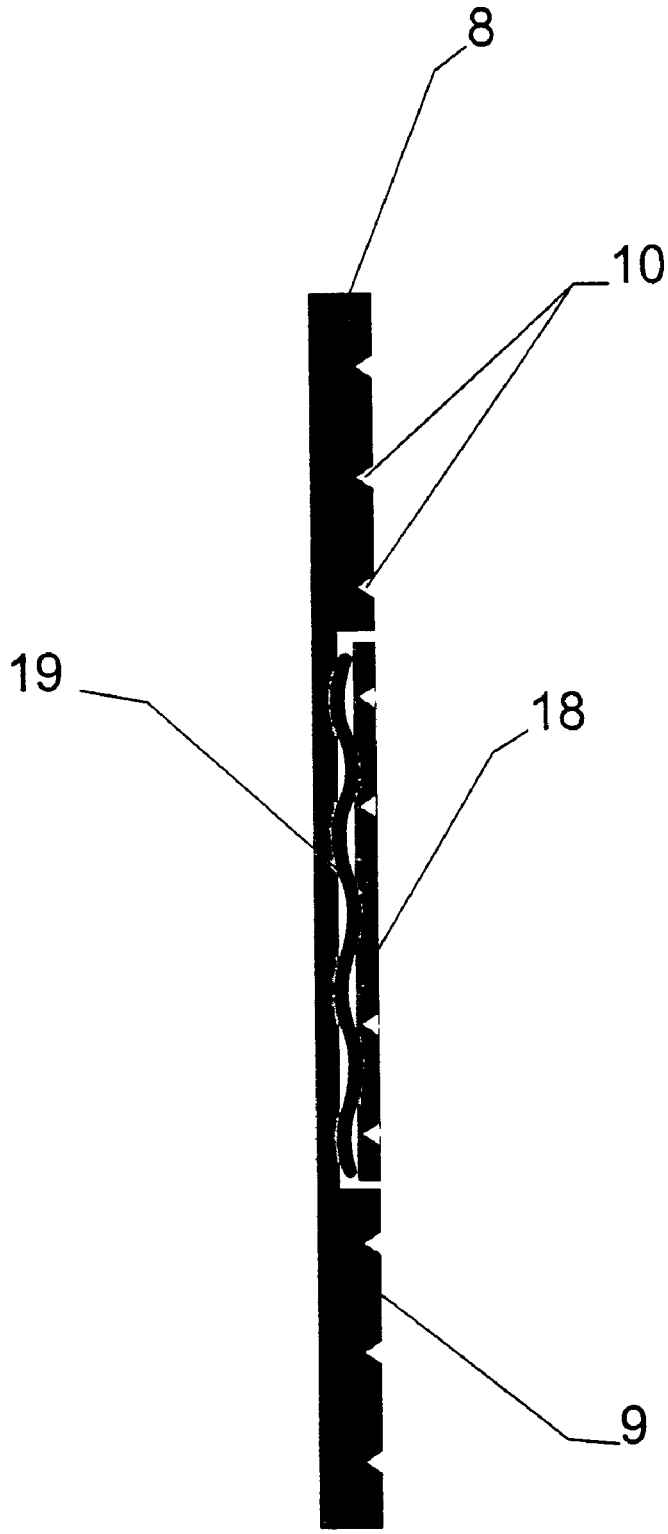
FIG. 5 depicts an alternative form of the element of FIG. 4.

In the alternative form illustrated in FIG. 5, the apparatus is identical to the one set out in FIGS. 1 to 4 except for the location of the striations, which in this instance are arranged on the face (9) of the disk (8) and the face of the inner disk (18) that face toward the inlet orifice (7).

The apparatus works as follows: once the reservoir has been filled and the heating body (13) has been raised to the operating temperature, typically of the order of 140 to 240° C., the pump is operated (or, if water at mains pressure is being used, an electric valve is opened) and water is forced to enter the vaporizing chamber (5) by the parting of the disks (8, 9) from the inlet orifice (7). As a preference, the resistive force of the springs (12, 19) is chosen to allow water to enter the vaporizing chamber at a pressure of between 2 and 7 bar.

Once introduced into the vaporizing chamber (5), toward the central region of the disk (8), the water is instantly turned into steam upon contact with the disks (8, 18) and the wall (6) of the vaporizing chamber (5) that contains the inlet orifice (7). The steam thus formed moves toward the periphery of the disk (8) and enters the labyrinth (14) where it is superheated, typically up to 160° C., before being conveyed via the duct (17) to the outlet orifices (16) to be injected into the fabric being ironed. The residue of unvaporized water and/or the condensate present in the vaporizing chamber (5) is trapped in the concentric striations (10) that form a mini-boiler closed by contact between the disk (8) and the wall (6) of the vaporizing chamber (5) that contains the inlet orifice (7). This water in turn instantly turns into steam at a high temperature and a high pressure and the steam thus formed forms part of the overall vaporization that escapes to the periphery of the disk.

It goes without saying that the invention is not restricted to the examples described hereinabove.

The description has covered a moving wall lying inside the sole. It is also possible to arrange it on the sole.

It should be pointed out that the moving wall of the vaporizing chamber, which does not necessarily have to have the shape of a disk, accelerates the conversion of water into steam while at the same time improving the reliability of the system. This is because the system is considerably simplified through the fact that the moving wall also acts as a valve.

The presence of the striations considerably improves the quality of the steam injected into the fabric because the presence of unvaporized water is eliminated and the iron no longer spits.

The number of disks used is not necessarily limited to a maximum of two. It is perfectly conceivable to form a cylindrical cavity in the inner disk, this cavity containing another disk arranged on a spring.

It must finally be noted that, with the iron according to the present invention, unlike apparatuses of the prior art, the vaporization temperature and pressure do not vary.

The invention claimed is:

1. An ironing apparatus comprising an iron, a water reservoir and a pipe connecting the reservoir to the iron, the sole of the iron comprising a vaporizing chamber designed to generate steam from water originating from the reservoir, the vaporizing chamber comprising, on one of its walls, a water inlet orifice, the iron further comprising means for opening and closing said inlet orifice, the ironing apparatus being characterized in that it comprises means for forcing the displacement of the water, which means are arranged between the reservoir and the vaporizing chamber, the vaporizing chamber comprising a moving wall arranged parallel to and facing the wall that has the inlet orifice, said moving wall acting as a valve for said inlet orifice, wherein the moving wall has the shape of a disk, the face of the disk not facing said inlet orifice being in contact with a spring arranged in such a way that it exerts a force on the disk toward the inlet orifice.

2. The apparatus as claimed in claim 1 characterized in that under the inlet orifice, the disk has a cylindrical cavity which contains an inner disk arranged on a spring.

3. The apparatus as claimed in claim 1 characterized in that the face of the disk and/or of the inner disk that faces toward the inlet orifice has concentric striations.

4. The apparatus as claimed in claim 1, characterized in that the wall of the vaporizing chamber that contains the inlet orifice has concentric striations.

5. The apparatus as claimed in claim 3, characterized in that the cross section of the concentric striations is V-shaped.

* * * * *